US006431385B1

(12) United States Patent
Palmer

(10) Patent No.: US 6,431,385 B1
(45) Date of Patent: Aug. 13, 2002

(54) WIDE-MOUTH RECLOSABLE CONTAINER AND COVER DEVICE

(76) Inventor: Kenneth S. Palmer, 5000 W. Lakeridge Rd., Denver, CO (US) 80219

( * ) Notice: Subject to any disclaimer, the term of this patent is extended or adjusted under 35 U.S.C. 154(b) by 0 days.

(21) Appl. No.: 09/652,319

(22) Filed: Aug. 31, 2000

Related U.S. Application Data

(63) Continuation-in-part of application No. 09/224,403, filed on Dec. 31, 1998, now Pat. No. 6,149,023.

(51) Int. Cl.[7] ..... B65G 45/16
(52) U.S. Cl. ..... 220/324; 215/273
(58) Field of Search ..... 220/324, 378, 220/806, 795, FOR 111, 108, 801–804; 215/273, 286, 289; D7/612, 615; 227/632, 339, 641, 644, 645, 648, 649, 639–643

(56) References Cited

U.S. PATENT DOCUMENTS 1,441,641 A * 1/1923 Thompson ..... 220/324
2,674,390 A * 4/1954 Meyer ..... 220/46
3,464,579 A * 9/1969 Asenbauer ..... 220/4
3,768,819 A * 10/1973 Burkert ..... 277/206
4,759,555 A * 7/1988 Halling ..... 277/200
D381,872 S * 8/1997 Lin ..... D7/612
6,029,977 A * 2/2000 Sym ..... 277/312

FOREIGN PATENT DOCUMENTS

GB 18810 * 5/1908 ..... 220/FOR 111

* cited by examiner

*Primary Examiner*—Lee Young
*Assistant Examiner*—Lien Ngo

(57) ABSTRACT

A wide-mouth reclosable container and cover device for containment of liquids such as paint and various other substances. The device includes a container and a mating cover. The container has a lower portion and an upper portion. The upper portion has a wide-mouth opening with a top flange disposed around the opening. The container includes three recesses therein for receiving catch mounts with tapered catches pivotally attached. The catches are used for engaging notches in catch mounts mounted on the cover. The catches hold an underside of the cover against the top flange of the container. The underside of the cover includes a groove for receiving a seal ring with a "V" shaped point. On opposite sides of the groove are "half-V" spacers for limiting the compression of the seal ring on the top flange.

13 Claims, 3 Drawing Sheets

WIDE-MOUTH RECLOSABLE CONTAINER AND COVER DEVICE

This application is a continuation-in-part application of patent application Ser. No. 09/224,403, filed on Feb. 31, 1998, now U.S. Pat. No. 6,149,023, having a title of "WIDE-MOUTH RECLOSEABLE CONTAINER AND COVER WITH PIVOTING BAILS", Inventor: Kenneth S. Palmer.

BACKGROUND OF THE INVENTION (a) Field of the Invention

This invention relates to containers and more particularly, but not by way of limitation, to a wide-mouth recloseable container and cover device for storing liquids and other substances that are susceptible to hardening and/or other changes in character when exposed to air.

(b) Discussion of Prior Art

Heretofore, due to automated, high-volume production methods, prior-art containers are very economical to manufacture. Also these containers provide excellent product protection from the time of filling until the contents are first used. In many instances, however, a container is not completely emptied during first use and a user closes and stores the remainder for later use. This procedure is especially common with commercial-quality paint and varnish products. Also, quite often a stored container of such material is re-opened and re-closed several times. In this situation, two major shortcomings of conventional containers become evident, frequently to the user's annoyance. If the container is sheet metal, usage of the contents invariably results in residue accumulating in the lid recess that surrounds the container opening. Unless wiped away before the lid is re-installed, the residue usually hardens and creates two problems: (1) The dried residue makes the next lid removal difficult and time consuming, and (2), the dried residue severely interferes with subsequent closing of the container. Typically, this residue will prevent the lid from properly re-seating and re-sealing, thereby allowing air entry. The air entry often leads to forming a crust over the contents. In such situations, the crust renders the contents virtually worthless and the container is then simply discarded with its unusable contents therein.

Also, if the container is plastic, there usually is no recess in the edges around the top of the container opening. But, during usage, drips or other formations of excess material accumulate around the container's outer circumference. As with sheet-metal containers, such material hardens and ultimately prevents effective re-sealing of the cover, unless first wiped away. Again, a crust usually forms as a result of the container not being air tight, thereby effectively ruining the contents therein.

U.S. Pat. No. 3,701,452 to Tonn discloses a sealing gasket used with a container and having a rotatable bolt and locking nut for securing a container lid on top of an upper flange of the container. U.S. Pat. Nos. 4,699,293 to Duchrow and 2,272,538 to Wirth describe two different types of electrical boxes with container lid seals. Either bolts or bails are used to retain the lid around the top of the open top electrical container box.

U.S. Pat. No. 5,085,337 to Kos illustrates a shock-resistant liquid container having a gasket system for sealing a cover on top of the container. Latches with hooks are used for engaging and compressing the cover on top of the container. U.S. Pat. Nos. 5,029,724 to Serio and 3,070,868 to Dell et al disclose two different types of locking systems for a hinged container lid and a burial vault.

None of the above mentioned prior art containers and container lids provide the unique combination of structure and features of the subject wide-mouth recloseable container and cover device for holding and storing liquids, powders and other substances for various lengths of time.

SUMMARY OF THE INVENTION

In view of the foregoing, it is a primary object of the subject invention to provide a wide-mouth recloseable container and cover device for containment of liquids such as paint, and various other substances. The new container and cover device is specifically designed for providing effective storage and long-term sealing against spillage and air entry. The invention is particular effective in preventing the air drying of the stored contents for extended time periods of storage Another object of the invention is that the container and cover device may be made in a quart, a gallon or various sizes, depending on the requirement. The container and cover may be made of readily available types of plastics or metals and is designed to be relatively economical to manufacture.

Yet another object is the invention is to provide a convenient reusable storage container for "left-over" quantities of substances that originally are supplied in conventional, wide-mouth-receptacles. The container and cover device provide for easy and airtight sealing on a repetitive basis.

The container and cover device includes a container and a mating cover which are cylindrical in shape. The container has a lower portion and an upper portion. The upper portion of the container has a wide-mouth opening with a top flange disposed around the opening. Also, the upper portion includes a neck portion and a beveled portion disposed below the neck portion. The neck portion is disposed next to and extends downwardly from the top flange. The beveled portion includes three recesses therein and equally spaced around the circumference thereof. The three recesses are used for receiving catch mounts.

Each catch mount includes a pair of openings adapted for receiving one end of a horn element of a sonic-welding tool. The welding tool is used for attaching the catch mounts to the sides of the recesses. The catch mounts also include a "U" shaped recess for receiving a cylindrical rubber bushing. The rubber bushing has a length equal to the width of the catch mount. Opposite ends of tapered wire catches are bent and inserted into opposite ends of the bushing prior to the catch mounts being welded to the container. The catches are used for engaging the sides of an upper surface of the cover for holding a lower surface of the cover against the top flange of the container.

A lower surface of the mating cover has an annular groove for receiving a hollow compressible seal ring therein. A first half of a "V" shaped spacer is disposed on one side of the groove and a second half of the "V" shaped spacer is disposed on the other side of the groove. The first half and the second half of the spacer are used to limit the compression of the seal ring. An upper surface of the cover includes three upwardly extending ramps with a notch therein. Each of the notches are used for receiving an upper portion of each catch and securing the cover to the top of the container.

The cover also includes three indexing ribs equally spaced around a circumference of a annular flange in the lower surface of the cover. The indexing ribs are received inside indexing notches. The indexing notches are equally spaced around the inside of the wide-mouth opening in the upper portion of the container. The use of the indexing ribs and indexing notches provide a way of correctly positioning the cover on top of the container so that the catches are positioned for rotating upwardly and engaging the notches in the ramps. Also, if the indexing ribs are not properly received inside the indexing notches, the cover is prevented from being closed and latched on top of the container.

These and other objects of the present invention will become apparent to those familiar with the different types of containers and receptacles used for storing liquids and other substances when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
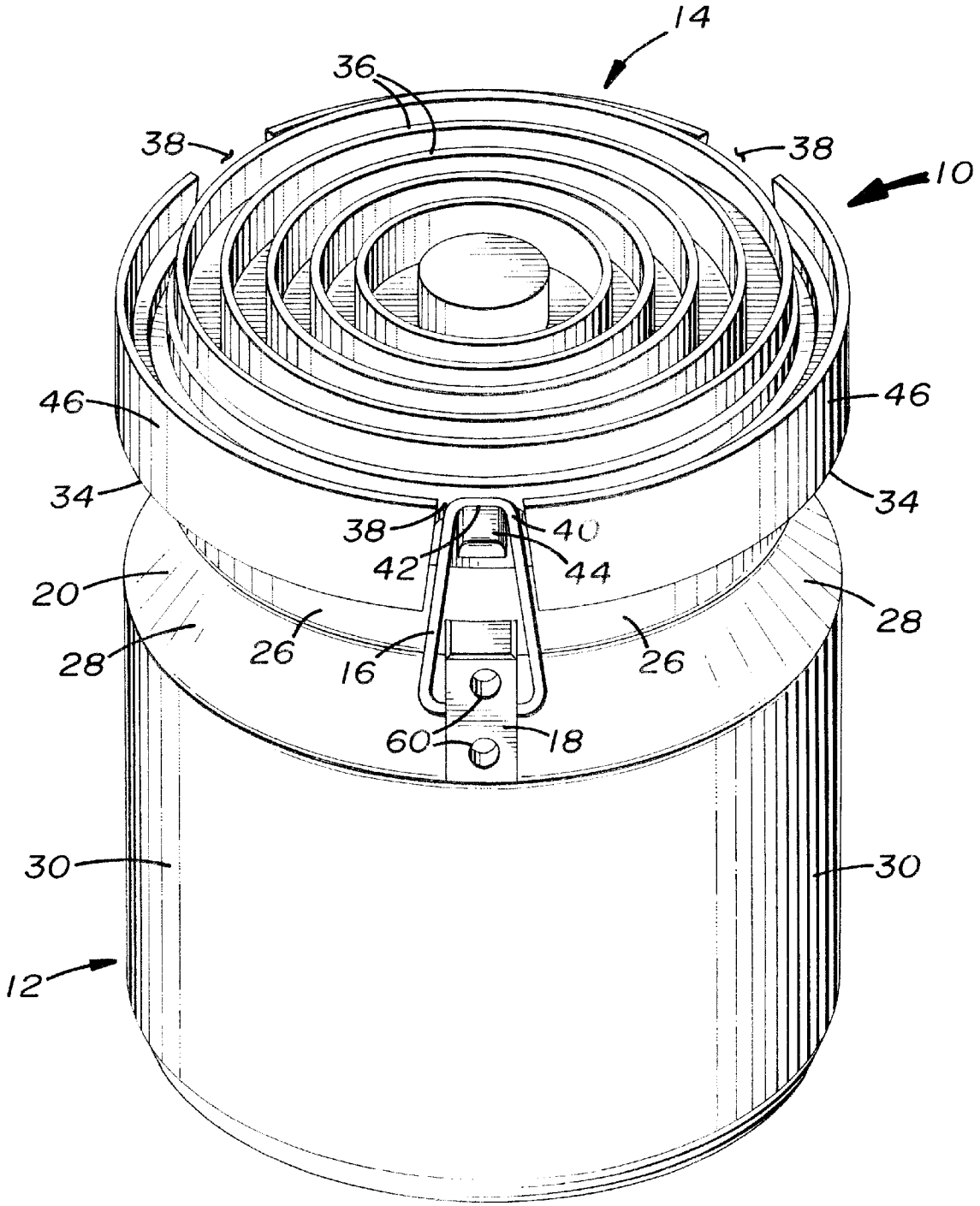
FIG. 1 is a perspective view of the subject wide-mouth container and cover device with a cover disposed on top of a container and secured thereto using three catches pivotally attached to sides of the container.

In FIG. 1, a perspective view of the subject container and cover device is shown having a general reference numeral 10. Broadly, the device 10 includes a wide-mouth container and a cover. The container and cover are also shown having general reference numerals 12 and 14. In this drawing, the cover 14 is shown secured to the top of the container 12 using three catches 16 pivotally attached to catch mounts 18 welded to sides of the container 12. Only one of the catches 16 and one of the catch mounts 18 are shown in FIG. 1.

Figure 3:
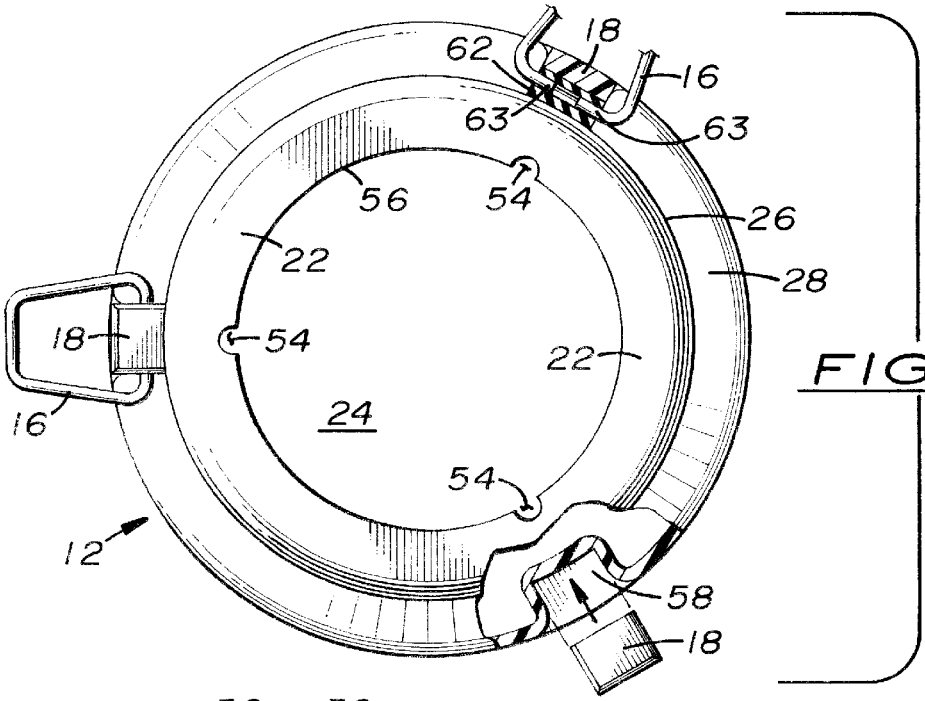
FIG. 3 is a top view, taken along lines 3—3 shown in FIG. 2, of the container illustrating a wide-mouth opening in the top thereof and three indexing notches equally spaced around a circumference of the opening.

The container 12 includes an upper portion 20 with an inwardly extending horizontal top flange 22 therearound and a wide-mouth opening 24 therein. The opening 24 is used for receiving liquids or various other types of substances for short and long-term storage. The flange 22 and opening 24 are shown in FIG. 3. The upper portion 20 includes a neck portion 26 disposed next to the top flange 22. The neck portion 26 extends downwardly merging into a beveled portion 28. The beveled portion 28 also extends downwardly merging into a lower portion 30 of the container 12. The upper portion 20 and the lower portion 30 make up the exterior of the container 12 with the wide-mouth opening 24 making up the interior of the container.

The cover 14 includes an upper surface 32 and an underside 34. The upper surface 32 includes a plurality of circular ribs 36. The ribs 36 provide structural rigidity and support for the cover 14 when the underside 34 is received on and compressed against the top flange 22 of the container 12 and when securing and releasing the cover 14 from the container 12. Also, the ribs 36 accommodate conventional molding and casting practice that dictates avoidance of thick cross sections.

Figure 7:
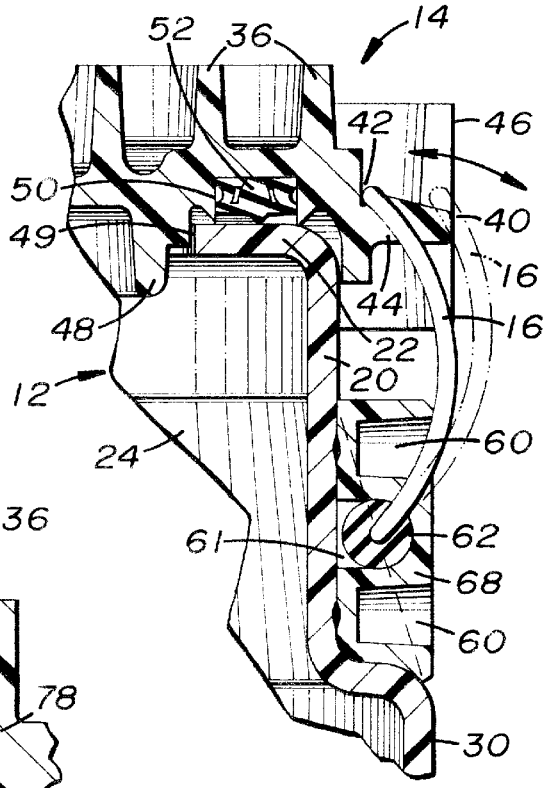
FIG. 7 is a sectional view of a portion of the cover engaged on top of a portion of the container using a catch received in a notch in a catch ramp formed in a side of the cover. In this view, a cross section of the seal ring is shown compressed against a top of a flange received around the wide-mouth opening in the container.

An outer rib 36 of the cover 14 includes three spaced apart catch openings 38. The catch openings 38 are used for receiving an upper portion 40 of each catch 16. The upper portion 40 of the each catch 16 is received in a notch 42 in a catch ramp 44 formed in an outer circumference 46 of the cover 14, as shown in FIG. 7, when the cover 14 is secured to the top of the container 12.

Figure 2:
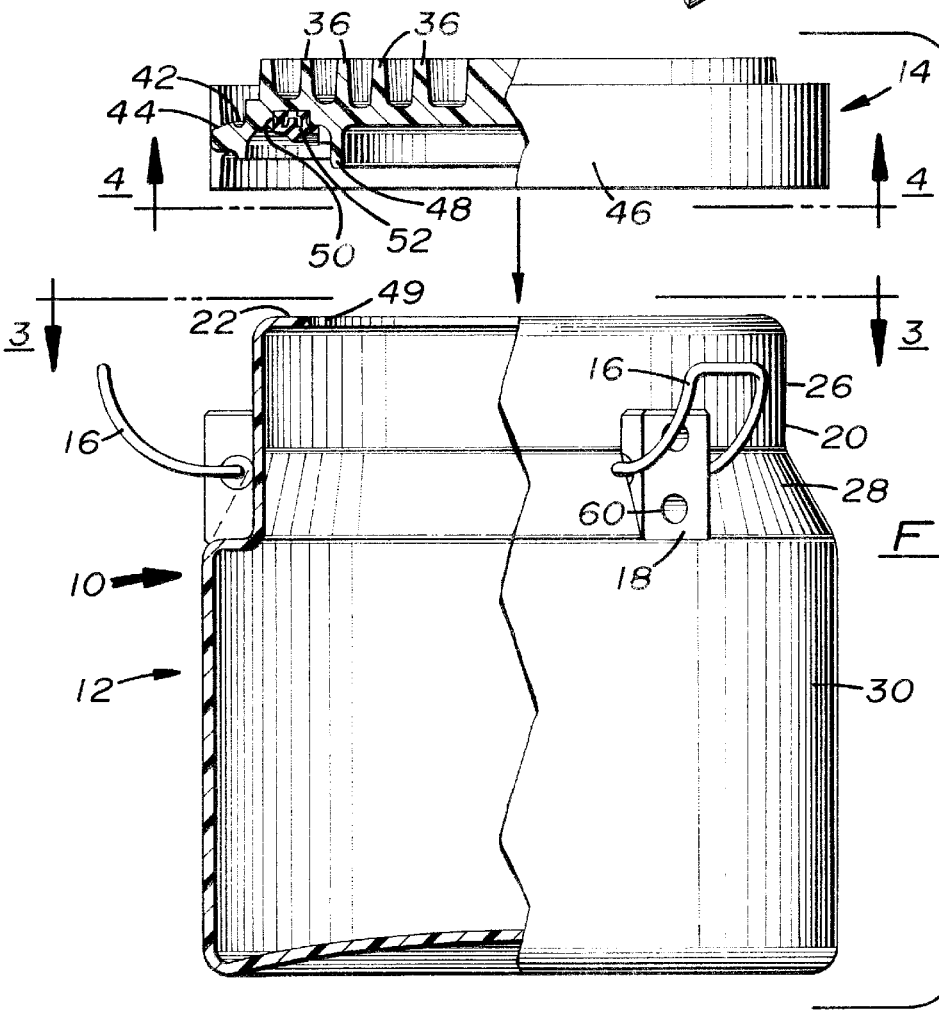
FIG. 2 is a side elevation view of the subject wide-mouth container and cover device with the cover shown in a released position above a upper portion of the container. In this view, the catches are shown in a lowered position.

In FIG. 2, a side elevation view of the subject wide-mouth container and cover device 10 is shown with the cover 14 in a released position above the upper portion 20 of the container 12. In this view, the catches 16 have been partially lowered and released from the notches 42 in the catch ramps 44.

Figure 5:
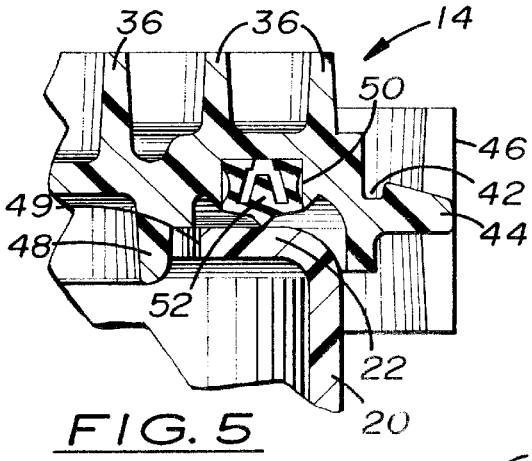
FIG. 5 is a sectional view of a portion of the cover resting on top of a portion of the container. In this view, a cross section of the seal ring is shown received in the annular seal groove in the underside of the cover. The seal ring is shown uncompressed.
Figure 6:
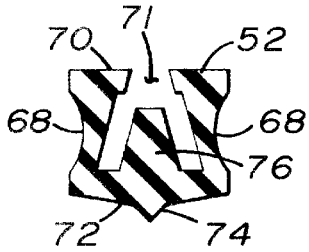
FIG. 6 is an enlarged sectional view of the seal ring shown in FIG. 5.

In this drawing, a portion of the left side of the container 12 has been cut-away to expose a portion of the wide-mouth opening 24 in the inside of the container 12. Also, a portion of the left side of the cover 14 has been cut-away to expose a portion of the circular ribs 36, the notch 42 and catch ramp 44. The underside 34 of the cover 14 includes a downwardly extending vertical pilot flange 48. An outer circumference of the vertical pilot flange 48 is received next to an edge 49 of the top flange 22 when the cover 14 is received on top of the container 12 as shown in FIGS. 5–7. Also, the underside 34 between the vertical flange 48 and the outer circumference 46 includes an annular seal ring groove 50 therein for receiving an annular hollow compressible seal ring 52. The groove 50 and ring 52 are shown in greater detail in FIGS. 5–8.

In FIG. 3, a top view, taken along lines 3—3 shown in FIG. 2, of the container 12 is illustrated. In this drawing, the wide-mouth opening 24 is shown with three vertical indexing notches 54 equally spaced around a circumference 56 of the opening 24. Also shown in the drawing is one of the catch mounts 18 positioned for being inserted into a catch-mount recess 58 in a portion of the beveled portion 28 of the container 12. Each of the catch mounts 18 includes a pair of openings 60 adapted for receiving a horn of a sonic welding tool. The welding tool used for welding the catch mounts 18 to the sides of the container 60. The openings 60 in the catch mounts 18 are shown in FIGS. 1 and 2.

Also, the catch mounts 18 include a "U" shaped bushing recess 61 in the rear thereof for receiving a rubber bushing 62 therein. One of the catch mounts 18 is shown in cross section with the bushing 62 mounted therein. The "U"

shaped bushing recess 61 is shown in FIG. 7. The catches 16 have tapered sides with bent ends 63 and a gap therebetween. The bent ends 63 are received in the opposite ends of the bushing 62.

The bushing 62 prevents free pivoting of the catch 16 for ease in engaging the catch ramp 44. Also, the bushing 62 holds the catch 16 in a raised position next to the catch ramp 14 prior to engaging the catch ramp 44. Further, the catch 16 can be lowered and held in a down position by the bushing 62 to prevent the catch 16 from coming into contact with the contents of the container 12 when it is poured therefrom.

During the welding of the catch mounts 18 to the sides of the container 12, the rubber bushings 62 are first inserted into the "U" shaped bushing recesses 61. The bent ends 63 of the catches 16 are spread apart with the ends inserted into the opposite ends of the bushing 62 as mentioned above. The mounts 18 are then inserted in the catch-mount recesses 58 and welded to the sides of the container 12.

Figure 4:
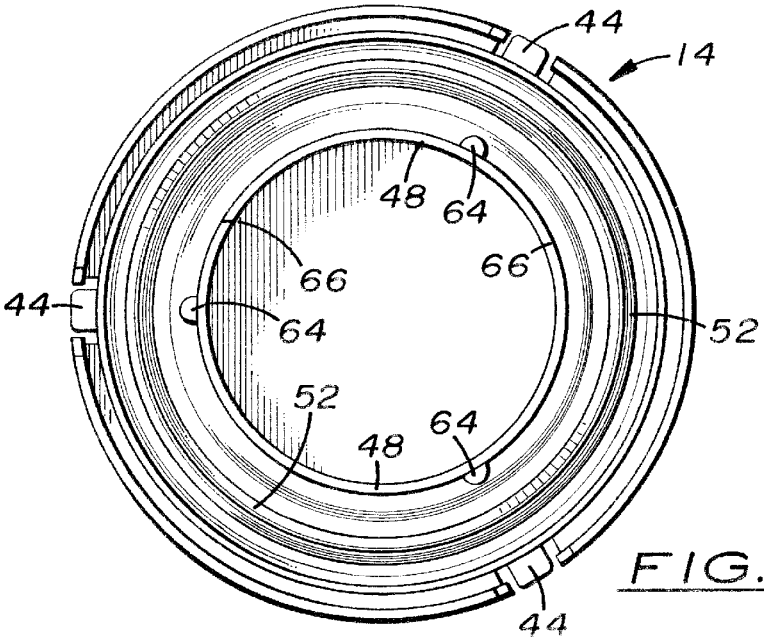
FIG. 4 is a bottom view, taken along lines 4—4 shown in FIG. 2, of an underside of the cover and illustrating an annular seal ring mounted in a seal groove. Also, a vertical cover flange is shown with three indexing ribs equally spaced around an outer circumference of the cover flange.

In FIG. 4, a view taken along lines 4—4 shown in FIG. 2, of the underside 34 of the cover 14 is illustrated. In this view, the annular seal ring 52 is shown positioned in the seal ring groove 50. Also, the vertical pilot flange 48 is shown with three indexing ribs 64 equally spaced around an outer circumference 66 of the vertical pilot flange 48.

When closing the cover 14 on top of the container 12, the indexing ribs 64 are rotated on top of the top flange 24 until the ribs 64 are received in the indexing notches 54 in the circumference 56 of the wide-mouth opening 24. At this time, the cover 14 can be moved downward on the container 12 with the indexing ribs 64 received in the indexing notches 54. When this occurs, the indexing of the ribs 64 and notches 54 properly align the catches 16 with the catch ramps 44. The catches 16 can then be pivoted upwardly with the upper portion 40 of the catches 16 engaging the notch 42 in the catch ramps 44. This feature is shown clearly in FIG. 7.

It should be noted in FIGS. 2 and 7 that the catches 16 are curved inwardly. When the catches 16 are pivoted upwardly and engage the catch ramps 44 and at the same time the cover 14 is moved down on the container 12, the catches 16 are slightly flattened, to allow the upper portion 40 to be received in the notch 42. This particular feature helps eliminate the need for a large downward force on the cover 14 when securing the cover 14 to the top of the container 12.

In FIG. 5, a sectional view of a portion of the cover 14 is shown resting on top of a portion of the container 12. In this view, a cross section of the seal ring 52 is shown received in the annular seal ring groove 50 in the underside 34 of the cover 14. The seal ring 52 is shown uncompressed. A cross section of the uncompressed seal ring 52 is shown in greater detail in FIG. 6.

In FIG. 6, an enlarged sectional view of the seal ring 52 is illustrated. In this drawing, the seal ring 52 is shown with sides 68, a flat top portion 70, a centrally located gap 71 in the top portion 70 and a bottom portion 72 having a "V" shaped point 74. The "V" shaped point 74, when compressed against the top of the top flange 22, provides for minimum contact and an air-tight seal thereon for ease in releasing the cover 14, after extended storage of the product, from the container 12. The seal ring 52 is hollow for ease in compression and includes an internal stop 76.

Figure 8:
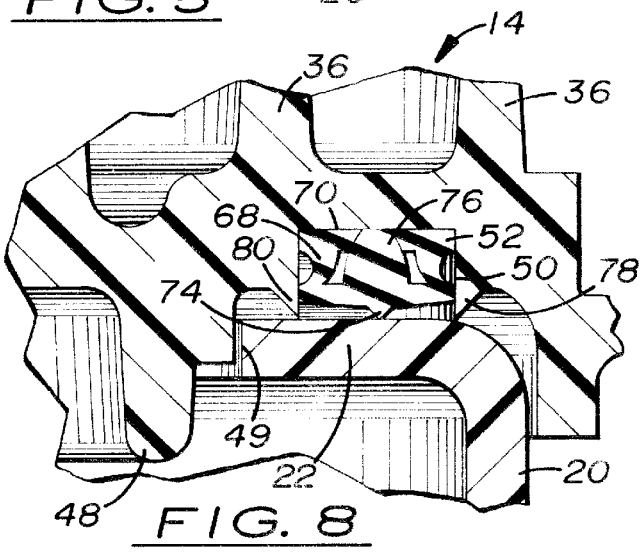
FIG. 8 is an enlarged sectional view of the portion of the cover and the top portion of the container shown in FIG. 7.

When the seal ring 52 is compressed, as shown in FIGS. 7 and 8, the "V" shaped point 74 maintains contact against the top of the top flange 22. During the compression of the seal ring 52, the stop 76 moves upward through the gap 71 in the top portion 70 until the top of the stop 76 presses against the underside of the seal ring groove 50. Until this contact occurs, the seal ring 52 has relatively low resistance to compression. But, this contact does significantly increase the resistance of the seal ring 52 against the top flange 22. Because of these characteristics, the seal ring 52 is termed to have a "double action".

The reason for the seal ring's double action is that when the cover 14 is to be closed and latched, it must be moved downward enough for clearances to exist between the upper portion 40 of the catches 16 and their respective catch ramps 44. These clearances permit the catches 16 to easily pivot into the notches 42. However, the downward cover movement would be difficult for the average person to effect with one hand if the seal ring 52 was not quite resilient. By the time the downward movement of the cover 14 has created the above mentioned clearances for the catches 16, enough pressure between the seal ring's V-shaped point 74 and the top flange 22 exists to assure positive sealing. The pressure on the cover 14 is augmented by the interaction between the underside of the seal ring groove 50 and the seal ring's stop 76 during the final portion of the upward motion of the stop 76 received through the gap 71.

In FIG. 7, a sectional view of a portion of the cover 14 is shown engaged on top of a portion of the container 12 using the catch 16. In this view, the upper portion 40 of the catch 16 is shown in the notch 42 in the catch ramp 44. Also, the catch 16 is shown in dashed lines in an upward position prior to engaging the notch 42 in the catch ramp 44.

In FIG. 8, an enlarged sectional view is illustrated of the portion of the cover 14 and the top portion 20 of the container 12 as shown in FIG. 7. In this view, a cross section of the seal ring 52 is shown compressed against the top of the top flange 22 received around the wide-mouth opening in the container 12. On opposite sides of the seal ring groove 50 and extending downwardly are a first "half-V" spacer 78 and a second "half-V" spacer 80. These spacers 78 and 80 act to limit the compression of the ring seal 52 and prevent the ring seal from flatting out on the top flange 22. Also, the spacers provide additional depth to the groove 50. Further, the spacers 78 and 80 allow for minimization of the radial width of the top flange 22, thereby allowing for maximizing the diameter of the wide-mouth opening 24 in the container 12.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A reclosable container and cover device for holding liquids and other substances, the device comprising:

a cylindrical container, said container having a lower portion and an upper portion, the upper portion having an opening therein with a top flange disposed around said opening;

at least two catches, said catches having opposite ends pivotally mounted on catch mounts, said catch mounts attached to a side of said container;

a circular cover, said cover having an underside adapted for receipt on top of said top flange, said catches engaging a notch in catch ramps mounted on an outer circumference of said cover, said catches holding the underside of said cover against said top flange of said container; and an annular seal ring in the underside of said cover and therearound, said seal ring for engaging a portion of said top flange for providing an air-tight seal and minimum contact thereon for ease in releasing said cover from said container, said seal ring including a "V"-shaped point extending downwardly from a bottom of said seal ring, said "V"-shaped point engaging a portion of said top flange, said seal ring hollow and having sides, a top with gap therein, a bottom and an internal stop, the stop engaging a portion of a seal ring groove when the bottom of said seal ring is compressed against said top flange.

2. The device as described in claim 1 wherein the lower surface of said cover includes a spacer therearound and disposed next to said seal ring, said spacer extending downwardly for engaging a portion of said top flange, said spacer for limiting downward movement of said cover on said top flange, said spacer preventing the flatting out of said seal ring on said top flange.

3. The device as described in claim 2 wherein said spacer includes a first "half-V" spacer on one side of said seal ring and a second "half-V" spacer on an opposite side of said seal ring.

4. The device as described in claim 1 further including three catches equally spaced around a circunference of said container and mounted on three catch mounts, said catch mounts attached to the side of said container.

5. A reclosable container and cover device for holding liquids and other substances, the device comprising:

a cylindrical container, said container having a lower portion and an upper portion, the upper portion having an opening therein with a top flange disposed around said opening;

at least two catches, said catches having opposite ends pivotally mounted on catch mounts, said catch mounts attached to a side of said container, said catch mounts having a "U" shaped recess therein, said recess receiving a rubber bushing therein, the opposite ends of said catches received in ends of the bushing;

a circular cover, said cover having an underside adapted for receipt on top of said top flange, said catches engaging a notch in catch ramps on an outer circumference of said cover, said catches holding the underside of said cover against said top flange of said container; and an annular hollow seal ring in an annular seal ring groove in the underside of said cover and therearound, said seal ring having a "V"-shaped point extending downwardly for engaging a portion of said top flange for providing an air-tight seal and minumun contact thereon for ease in releasing said cover from said container.

6. The device as described in claim 5 wherein the opening in said container includes at least two indexing notches therein for receiving at least two indexing ribs, said indexing ribs disposed in a side of a vertical pilot flange in the underside of said cover.

7. The device as described in claim 5 wherein the opening in said container includes three indexing notches therein for receiving three indexing ribs, said three indexing ribs disposed in the side of said vertical pilot flange in the underside of said cover.

8. The device as described in claim 5 wherein said seal ring is hollow and includes sides, a top with gap therein, a bottom with a downwardly extending "V" shaped point and an internal stop, the sides and top of said seal ring received inside a seal ring groove, the stop engaging a portion of said seal ring groove when the "V" shaped point is compressed against said top flange.

9. A reclosable container and cover device for holding liquids and other substances, the device comprising:

a cylindrical container, said container having a lower portion and an upper portion, the upper portion having an opening therein with a top flange disposed around said opening;

three catches, said catches having opposite ends pivotally mounted on three catch mounts, said catch mounts equally spaced around a circumference of said contained and attached thereto, said catch mounts having a "U" shaped recess therein, said recess receiving a rubber bushing therein, the opposite ends of said catches received in ends of the bushing;

a circular cover, said cover having an underside adapted for receipt on top of said top flange, said catches engaging a notch in catch ramps on an outer circumference of said cover holding the underside of said cover against said top flange of said container; and an annular hollow seal ring in an annular seal ring groove in the underside of said cover and therearound, said seal ring having a "V"-shaped point extending downwardly for engaging a portion of said top flange for providing an air-tight seal and minimun contact thereon for ease in releasing said cover from said container.

10. The device as described in claim 9 wherein the opening in said container includes three indexing notches therein and equally spaced around a circumference of the opening in said container, said indexing notches for receiving three indexing ribs, said indexing ribs disposed in a side of a vertical flange in the underside of said cover and equally spaced around a circumference of the vertical flange.

11. The device as described in claim 9 wherein said seal ring is hollow and includes sides, a top with gap therein, a bottom with a downwardly extending "V" shaped point and an internal stop, the sides and top of said seal ring received inside a seal ring groove, the stop engaging a portion of said seal ring groove when the "V" shaped point is compressed against said top flange.

12. The device as described in claim 9 wherein the lower surface of said cover includes a spacer therearound and disposed next to said seal ring, said spacer extending downwardly for engaging a portion of said top flange, said spacer for limiting downward movement of said cover on said top flange, said spacer preventing the flattening out of said seal ring on said top flange.

13. The device as described in claim 12 wherein said spacer is includes a first "half-V" spacer on one side of said seal ring groove and a second "half-V" spacer on an opposite side of said seal ring groove.

* * * * *